US008240659B2

(12) United States Patent
Oshima et al.

(10) Patent No.: US 8,240,659 B2
(45) Date of Patent: Aug. 14, 2012

(54) POST-PROCESSING APPARATUS AND IMAGE FORMING SYSTEM HAVING POST-PROCESSING APPARATUS

(75) Inventors: Keisuke Oshima, Yokohama (JP); Naoki Matsui, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/185,379

(22) Filed: Jul. 18, 2011

(65) Prior Publication Data

US 2012/0018948 A1 Jan. 26, 2012

(30) Foreign Application Priority Data

Jul. 22, 2010 (JP) ..... 2010-164708

(51) Int. Cl.
*B65H 29/70* (2006.01)

(52) U.S. Cl. ..... 271/188; 271/209

(58) Field of Classification Search ..... 271/188, 271/209
See application file for complete search history.

(56) References Cited

U.S. PATENT DOCUMENTS 7,310,495 B2 * 12/2007 Kayama et al. ..... 399/406

FOREIGN PATENT DOCUMENTS

JP 2008-308251 A 12/2008

* cited by examiner

*Primary Examiner* — David H Bollinger
(74) *Attorney, Agent, or Firm* — Holtz, Holtz, Goodman & Chick, PC

(57) ABSTRACT

A post-processing apparatus including: a conveyance unit which conveys a sheet, having been carried-in, to a selected conveying destination among a plurality of conveying destinations; a stiffness imparting unit which imparts stiffness to the sheet being conveyed by the conveyance unit; and a control section which controls the stiffness imparting by the stiffness imparting unit, wherein the control section controls whether to impart or not to impart stiffness to the sheet, according to the selected conveying destination.

15 Claims, 10 Drawing Sheets

POST-PROCESSING APPARATUS AND IMAGE FORMING SYSTEM HAVING POST-PROCESSING APPARATUS

CROSS REFERENCE TO RELATED APPLICATION

The present application is based on Japanese Patent Application No. 2010-164708 filed with Japanese Patent Office on Jul. 22, 2010, the entire content of which is hereby incorporated by reference.

BACKGROUND OF THE INVENTION

1. Technical Field

The present invention relates to a post-processing apparatus for paper sheets and an image forming system having the post-processing apparatus.

2. Description of Related Art

A recent image forming apparatus of electrophotographic system and the like, having a high speed performance, multiple functions, and a network function, is widely utilized for printing apparatus, by being connected to a large capacity paper feeding apparatus and large capacity stacker apparatus. In cases of using the image forming apparatus as the printing apparatus, by connecting a post-processing apparatus for sorting, stapling, punching to file, and book-binding printed materials (image formed paper sheets), it is possible to execute printing through post-processing by one unit of apparatus.

As the above-mentioned post-processing apparatuses, various types of apparatuses having functions of a punching process to perforate for filing the sheets, a stapling process for binding a bundle of sheets with staples, a folding process to fold the bundle of sheets, and the like are conventionally provided.

The stapling process and the folding process are executed by conveying, with a conveyance unit, the sheets carried from the image forming apparatus onto a stacking section such as a stacker to temporarily accommodate the sheets, and stacking (accumulating) a prescribed number of sheets in the order of being conveyed.

In cases of conveying sheets to the stacker by the conveyance unit, when ejecting the sheets having low stiffness such as thin paper sheets, leading edges in ejecting direction of the sheets may hang down. In cases where the leading edge hangs down, the leading edge may be curled by contacting the sheets previously ejected onto the stacker or the accumulation surface of the stacker to cause a failure accumulation. Further, the hanged down leading edge may push out the previously accumulated sheets before completing the sheet ejection, by contacting the previously accumulated sheets.

To solve this problem, a sheet ejecting apparatus is disclosed having a control means which switches between an operation mode for imparting stiffness to the sheet to be ejected and an operation mode not for imparting stiffness, for example, in Unexamined Japanese Patent Application Publication No. 2008-308251 (Patent Document 1).

Patent Document 1, aims to improve alignment of accumulated sheets at sheet ejection and prevent damages to the sheets, by changing a condition of stiffening section between imparting stiffness and not imparting stiffness according to information of paper pressing direction.

As described above, in cases where a process, such as the stapling process, is executed by accumulating the prescribed number of sheets on the stacker, the sheets are ejected and stacked with the conveyance unit provided in front of the stacker. Since, between the conveyance unit and the accumulation position of the stacker, any member to control orientations of the sheets is not provided, the above described hanging down of the sheet edge may occur at the ejection to cause a failure stacking.

To impart stiffness on the sheets according to the sheet conditions, as described in Patent Document 1, with respect to this hanging down of the sheet edge, is effective to improve alignment of accumulated sheets at sheet ejection and prevent damages to the sheets.

However, in cases when a prescribed process such as the stapling process is executed by accumulating a prescribed number of sheets on the stacker, a subsequent sheet cannot be conveyed to the stacker while the process is being conducted. Therefore, during this time, operations of the image forming apparatus have to be temporarily stopped, which decreases a production ratio of the image forming apparatus.

In order not to decrease the production ratio, the image forming apparatus is required of continued operation even while the prescribed process is executed by accumulating the sheets on the stacker.

For this reason, it is required to convey the sheets carried in the conveyance unit for the stacker (conveyance unit the entry of stacker) toward another conveying destination, and to make them wait until becoming possible to be accumulated in the stacker. In this another conveying destination, a conveyance unit (conveyance roller) is required of returning the sheets having waited to the conveyance unit at the entry of the stacker.

In cases of conveying the sheet carried into the conveyance unit at the stacker entry toward a waiting conveyance path, if stiffness is imparted as the case of ejecting the sheet to the stacker, being affected by wave shaped corrugation in width direction of the sheet caused by imparting the stiffness, paper jamming may occur at conveyance rollers for returning sheet. More specifically, if the stiffness imparting is controlled only by the sheet conditions, as described in Patent document 1, there may be cases of causing the paper jam at the conveyance rollers for returning sheet.

The present invention is accomplished in view of the above situations, and an objective of which is to provide a post-processing apparatus that, in cases of executing post-processing by accumulating sheets in the stacker, does not cause a failure accumulation of sheet in the stacker or damage of sheet, does not cause a sheet jam at the time of sheet conveyance, and further does not cause decrease of production ratio of the image forming apparatus.

SUMMARY OF THE INVENTION

In order to achieve at least one of the above described objects, a post-processing apparatus reflecting one aspect of the present invention is provided with:

a conveyance unit which conveys a sheet, having been carried-in, to a selected conveying destination among a plurality of conveying destinations;

a stiffness imparting unit which imparts stiffness to the sheet being conveyed by the conveyance unit; and a control section which controls the stiffness imparting unit, wherein the control section controls whether to impart or not to impart stiffness to the sheet by the stiffness imparting unit, according to the selected conveying destination.

An image forming system reflecting another aspect of the present invention is provided with:

an image forming apparatus to form an image on a sheet, and the post-processing apparatus described above, which receives the sheet formed of the image by the image forming apparatus, and applies a post processing to the sheet.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Figure 1:
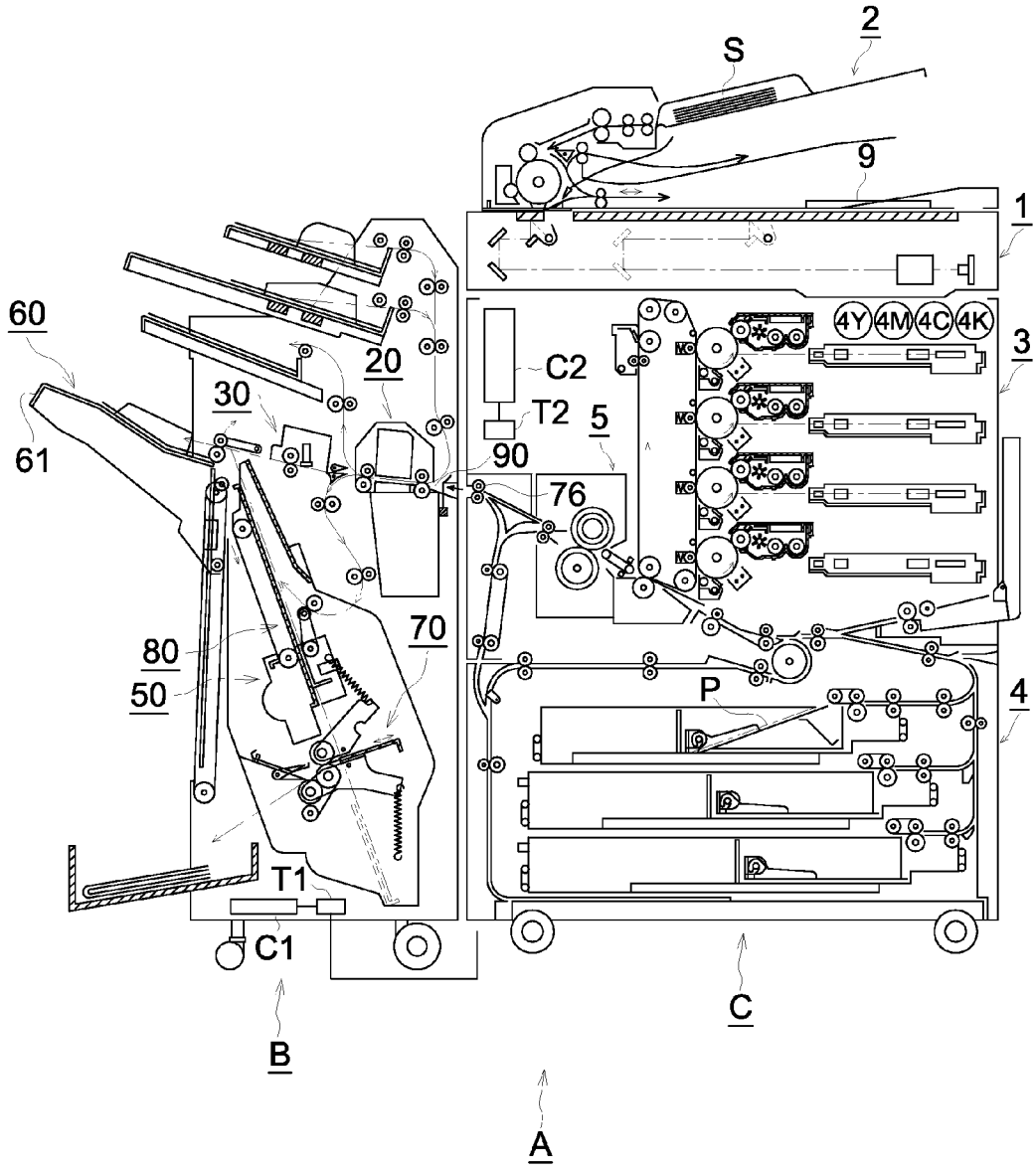
FIG. 1 is a drawing to show an example of image forming system relating to the present invention.

By referring to the drawings, embodiments relating to the present invention will be described below. The present invention is not restricted without departing from the feature and scope of the present invention.

In the description below, "a width direction" indicates a direction perpendicular to a conveying direction of the sheet.

An "upstream" indicates a direction from which the sheet is conveyed, and a "down stream" indicates a direction to which the sheet is conveyed.

FIG. 1 is a drawing illustrating an example of image forming system provided with a post-processing apparatus and an image forming apparatus.

Image forming system A is provided with image forming apparatus C and post-processing apparatus B, where image forming apparatus C executes image formation on sheet C, and post-processing apparatus B executes a post-process having been set, such as a punching process to make holes on sheet P, stapling process to bind a bundle of sheets with staples.

Image forming apparatus C of electrophotographic system is configured with original document image reading section 1, automatic document conveyance apparatus 2 to convey original document S, image forming section 3 to execute image formation based on original document image information read by original document image reading section 1, sheet feeding section 4 to supply sheet P to image forming section 3, fixing unit 5 to fix the toner image, operation panel 9 having a display section and operation switches, and control section C2 to control the system.

Image forming apparatus C and post-processing apparatus B are adjusted with position and height and installed such that sheet ejection roller 76 of image forming apparatus C coincide with receiving section 90 of post-processing apparatus B so that sheet P conveyed out from image forming apparatus C can be accepted at receiving section 90 of post-processing apparatus C.

Further, image forming apparatus C and post-processing apparatus B respectively have communication section T2 of image forming apparatus C and communication section T1 of post-processing apparatus B, and execute communication of various types of information under the controls of control section C2 and control section C1.

For example, information relating to the post-processing having been set on operation panel 9 of image forming apparatus C is transmitted via communication section T2 to communication section T1 of post-processing apparatus B, and post-processing apparatus B executes the post-process based on the transmitted information relating to the post-processing.

Figure 2:
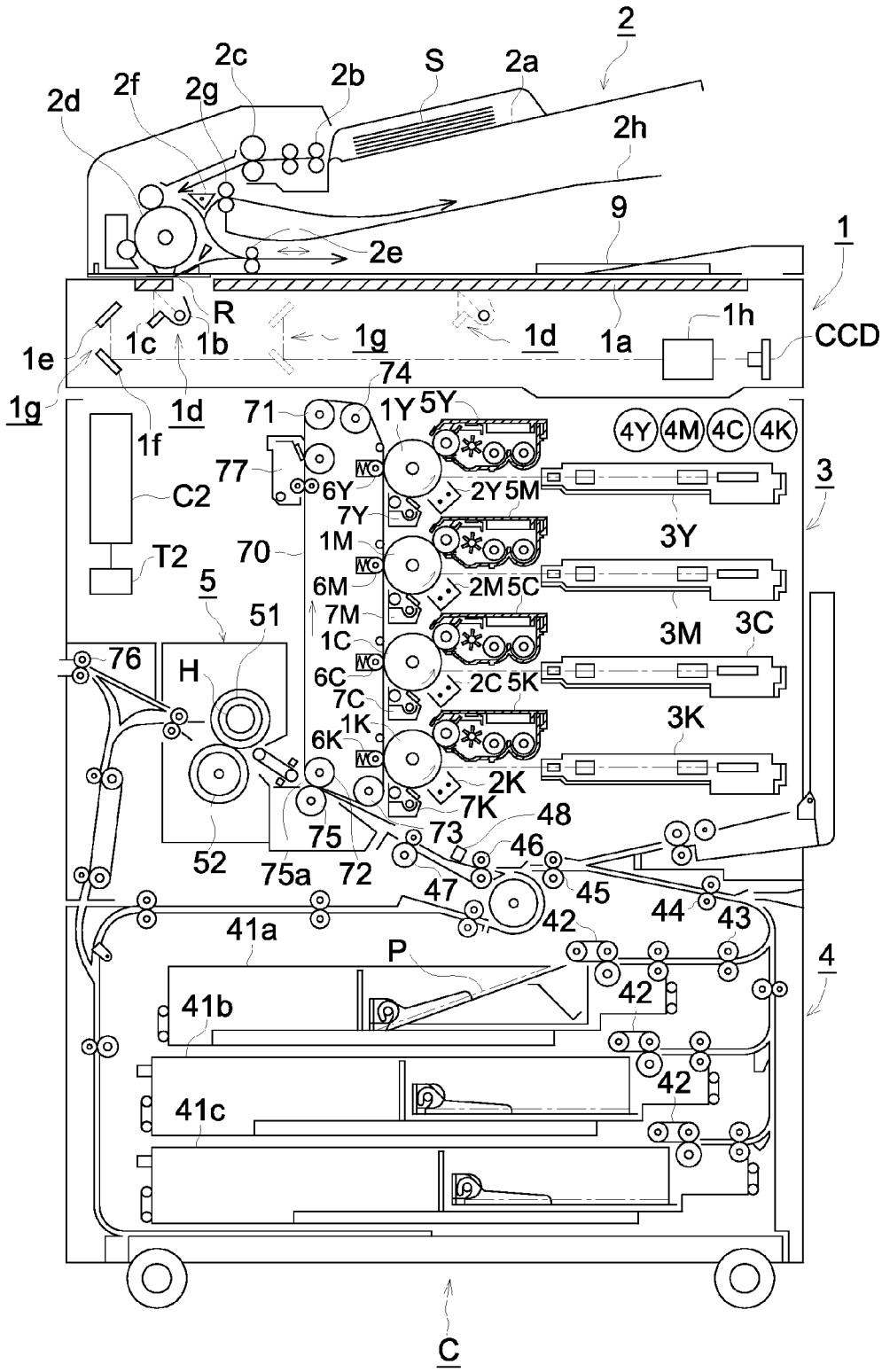
FIG. 2 is a sectional overview to show an example of image forming apparatus relating to the present invention.

FIG. 2 is a sectional overview to show an example of image forming apparatus C.

Automatic document conveyance apparatus 2 separates original document S loaded on sheet feed tray 2*a* one by one, and after conveying to original document reading area R, ejects onto ejection tray 2*h*.

Specifically, original document S accumulated on sheet feed tray 2*a* is separated and fed one by one with pair of feeding rollers 2*b*, and is sent to pair of registration rollers 2*c* arranged at down stream side of pair of feeding rollers 2*b*.

Original document reading section 1 is configured with first scanning unit 1*d* having light source 1*b* and first mirror 1*c*, second scanning unit 1*g* having second and third mirrors 1*e* and 1*f*, and optical system 1*h* to focus the original image onto a line image sensor CCD, wherein in case of reading operation of stationary optical system, by fixing first scanning unit 1*d* and second scanning unit 1*g*, the image of original document S conveyed by automatic document conveying apparatus 2 is read at original reading area R.

In case of reading operation of moving optical system, first scanning unit 1*d* and second scanning unit 1*g* move as shown by the dotted line in the sub-scanning direction (right direction in the drawing), the image of original document S placed on platen glass 1*a* is readout.

Analogue signals, of the original document image photoelectrically converted by the line image sensor CCD, are applied with analogue processing, A/D conversion, shading correction, image compression processing and the like, in an unillustrated image processing section to form digital image data of each color Y (yellow), M (magenta), C (cyan), and K (black).

Each of drum shaped photosensitive members 1Y, 1M, 1C, and 1K as a first image carrier corresponding to each color of Y, M, C, and K is uniformly charged by each charging unit 2Y, 2M, 2C, and 2K corresponding to each color.

Each of exposure units 3Y, 3M, 3C, and 3K corresponding to each color forms a latent image on each corresponding photosensitive member 1Y, 1M, 1C, and 1K based on digital image data of each color.

From toner replenishing unit 4Y, 4M, 4C, and 4K of each color to replenish new toner, each color toner is supplied to each developing unit 5Y, 5M, 5C, and 5K, and each latent image corresponding to each color formed on photosensitive member 1Y, 1M, 1C, and 1K is visualized by each developing unit 5Y, 5M, 5C, and 5K.

Developing units 5Y, 5M, 5C, and 5K, and photosensitive members 1Y, 1M, 1C, and 1K are arranged in tandem placement in vertical direction, and at the side of photosensitive members 1Y, 1M, 1C, and 1K arranged is intermediate transfer member 70 as a second image carrier which is a rotatably built semi-conductive endless belt trained about roller 71, 72, 73, and 74.

And, intermediate transfer member 70 is driven, in the allowed direction, via roller 71 by an unillustrated drive unit connected to roller 71.

Each primary transfer roller 6Y, 6M, 6C, and 6K corresponding to each color is selectively operated by control section 2C according to the type of image, to press intermediate transfer member 70 onto respectively corresponding photosensitive members 1Y, 1M, 1C, and 1K.

In this way, the toner image of each color formed on photosensitive members 1Y, 1M, 1C, and 1K is successively transferred onto rotating intermediate transfer member 70 and forms a synthesized color image.

After the toner image is transferred onto intermediate transfer member 70 by each primary transfer roller 6Y, 6M, 6C, and 6K, each photosensitive member 1Y, 1M, 1C, and 1K is removed of residual toner by each cleaning unit 7Y, 7M, 7C, and 7K.

Sheet feeding section 4 as a paper sheet supply means is configured, for example, with first sheet feeding cassette 41*a*, second sheet feeding cassette 41*b* and third sheet feeding cassette 41*c* each being a sheet accommodating member, and sheet P is accommodated in each sheet feed cassette.

Accommodated sheet P is separated one by one by sheet feeding unit 42 as a separation/supply unit, and is conveyed via a plurality of intermediate rollers 43, 44, 46, and registration rollers 47 to secondary transfer area 75*a*.

Then, the synthesized toner image on the intermediate transfer member is collectively transferred on sheet P by secondary transfer roller 75.

Only when sheet P passes through the transfer position for the secondary transfer, secondary transfer roller 75 is biased toward roller 72 to press sheet P onto intermediate transfer roller 70.

After transferring the color image onto the sheet by secondary transfer roller 75, intermediate transfer member 70, from which the sheet has been separated by curvature separation, is removed of residual toner by cleaning unit 77.

The sheet, on which the color toner image has been transferred, is fixed by fixing unit 5 having heat roller 51 incorporating heat source H and pressure roller 52.

Then, the fixed sheet is nipped by sheet ejection roller 76, and is supplied via an exit section to the post-processing apparatus of downstream process.

Figure 3:
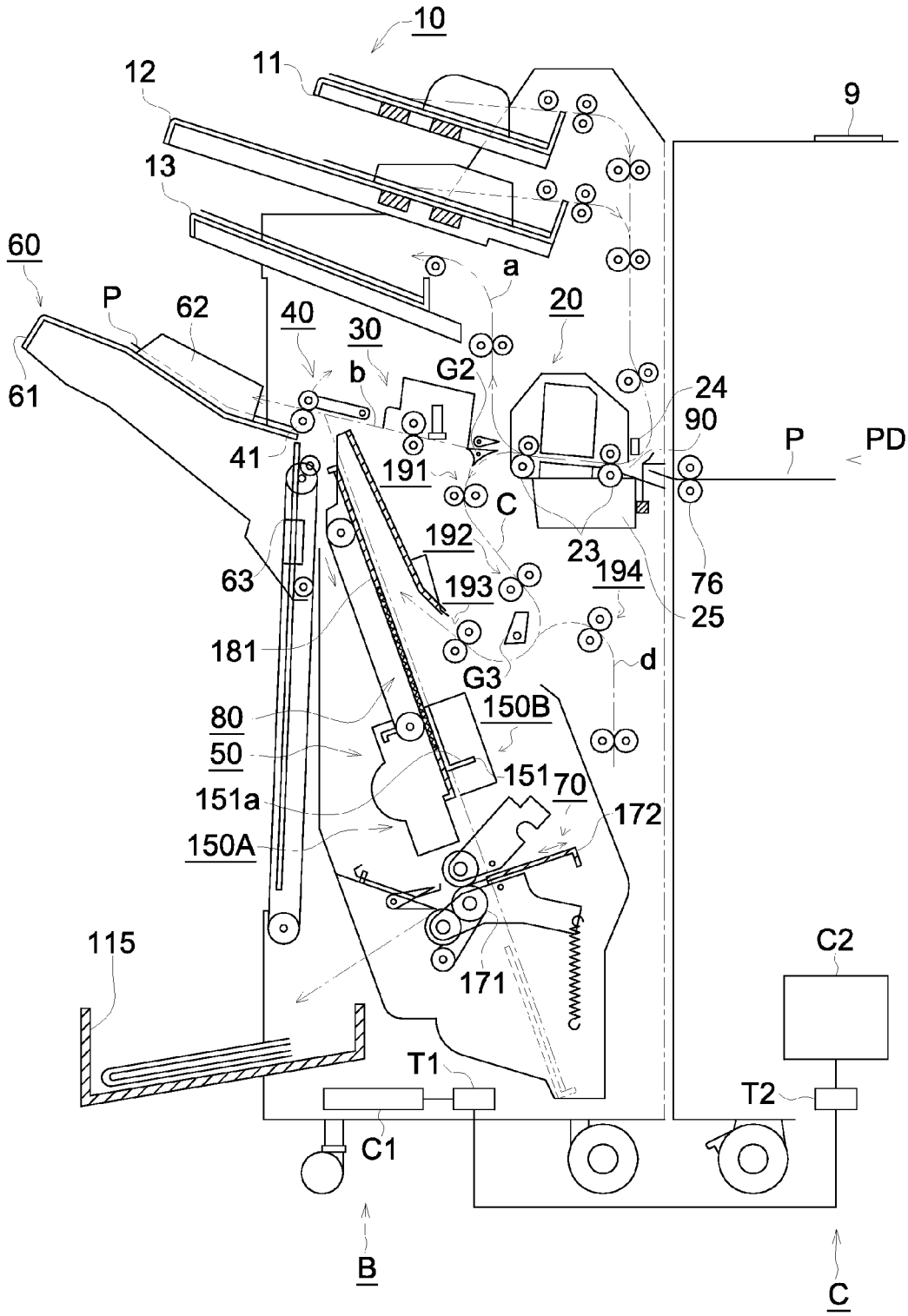
FIG. 3 is a sectional view to show an example of post-processing apparatus relating to the present invention.

FIG. 3 is a sectional view to show an example of post-processing apparatus B.

As the post-processing of sheet, there are for example, shifting process, stapling process, folding process, punching process, and book-binding process.

Post-processing apparatus B shown in FIG. 3 is an example configured with punching unit 20 to execute a punching process, shifting section 30 to execute a shifting process to shift sheet P in the width direction, stapling section 50 to execute a stapling process on a bundle of sheets, folding section 70 to execute a folding process on a bundle of sheets, stacker 80 to temporarily accumulate the sheet, sheet ejection section 60 to accumulate the sheet on sheet ejection tray 61, and control section C1 to control these units and sections.

In upper part of post-processing apparatus B, arranged is sheet supply apparatus 10 including first sheet supply tray 11, second sheet supply tray 12, and fixed sheet ejection tray 13.

In middle part of post-processing apparatus B, punching unit 20 to make holes on sheet P, shifting section 30 to shift sheet P in the width direction, and sheet ejection section 40 to eject the sheet are arranged in an approximately identical plane.

In lower part of post-processing apparatus B, stapling section 50 to bind a bundle of sheet P with staplers, folding section 70 to execute to fold a bundle of sheets or a sheet, and stacker 80 to temporarily stack the sheet are arranged in an approximately identical slanted surface.

Further, in the left side, sheet ejection section 60 to eject and accumulate the ejected sheet P or the bundle of stapled sheets, and fixed sheet ejection table 115 are arranged.

Sheet P fixing processed in image forming apparatus C is sent to receiving section 90.

Then, in cases when a punching process being set, punching unit 20 makes a punch hole, and incases of not being set, sheet P passes through punching unit 20.

In the vicinity of punching unit 20, provided are conveyance rollers 23 to convey sheet P, and sheet sensor 24 to detect an edge position in width direction and a downstream edge (trailing edge) of sheet P, and further punch scrap receptacle 25 is provided under punching unit 20.

In cases where only an accumulation process is set, sheet P is sent by switching gate G2 into conveyance path "a" to be accumulated on fixed ejection tray 13.

In cases where shifting process is set, sheet P is sent by switching gate G2 into conveyance path "b", shifted by shifting section 30 in the width direction, and accumulated on sheet ejection tray 61 of sheet ejection section 60 via ejection section 40.

Ejection tray 61 is adjusted by moving unit 63 such that an uppermost surface of the accumulated sheets on sheet ejection tray 61 comes to a conformed position to the sheet ejection position of ejection roller 41.

Further, in sheet ejection tray 61, aligning unit 62 executes aligning of the accumulated sheets in the width direction.

In cases where stapling process is set, sheet P is sent by switching gate G2 into conveyance path "c". The sent-in sheet P is nipped and conveyed by conveyance rollers 191 and 192, and further nipped and conveyed by stacker entry conveyance rollers 193, which are the conveyance unit to eject toward stacker 80, then sheet P is ejected to a space above stacker 80. After ejected to stacker 80, sheet P turns to going down by its own weight, slides obliquely downward along a slope surface of slope shoot 181, and stops by hitting sheet strike surface 151*a*. of movable stopper 151 with its trailing end (shown downward). Each of conveyance rollers 191, 192 and stacker entry roller 193 is structured with a pair of rollers configured with a drive roller and a driven roller, and is driven by a drive section (unillustrated).

Figure 4:
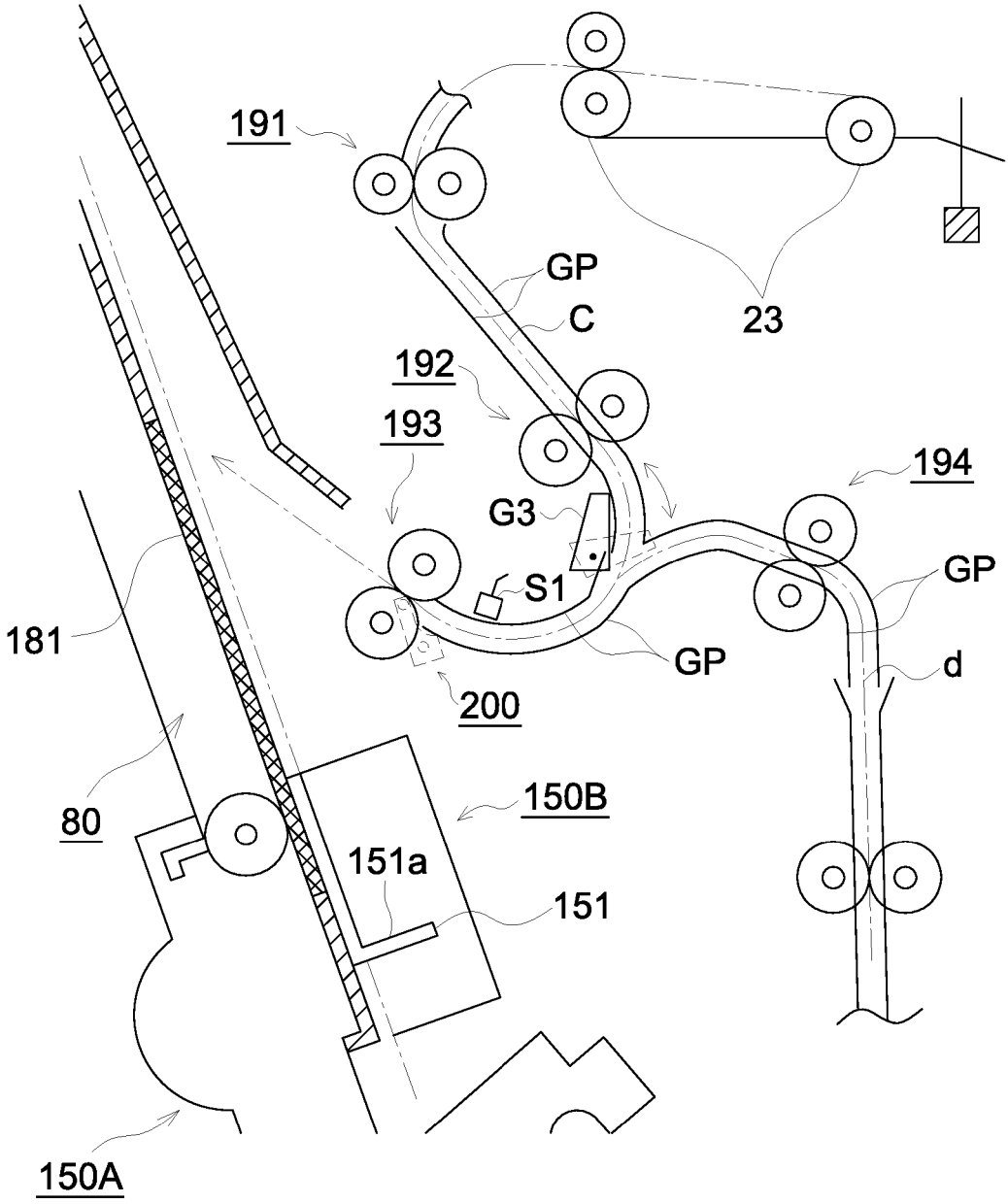
FIG. 4 is an enlarged view of a sheet conveyance path in a vicinity of stacker entry roller 193.

FIG. 4 is an enlarged drawing of sheet conveyance path near stacker entry rollers 193. Between each of the conveyance rollers, guide member GP is arranged to guide sheet P.

After a prescribed number of sheets have been stacked, the stacked sheet P is bound with staples by stapling section 50. Stapling section 50 is provided with staple shooting mechanism 150A and staple receiving mechanism 150B, and after the prescribed number of sheets P is accumulated on stacker 80, staple shooting mechanism 150A and staple receiving mechanism 150B are biased by the unillustrated drive section to execute stapling.

And, by lifting up movable stopper 151 after stapling, the stapled sheet P is accumulated on sheet ejection tray 61.

In cases where folding process is set, after the prescribed number of sheets is accumulated on stacker 80 similarly to the case of stapling process, folding section 70 folds the accumulated sheets P. Folding section 70 is provided with a pair of folding rollers 171 to fold by pressing a bundle of sheets, and shoving member 172 to shove the back of bundle of sheets between the pair of folding rollers 171. The bundle of sheets is pushed into the gap between the pair of folding rollers 171 by shoving member 172, and folded at the center portion to become a booklet state, namely to be executed with folding process. The bundle of sheets executed with the folding process by folding section 70 is ejected onto fixed sheet ejection table 115.

As well as executing total control of the above mentioned post-processing apparatus B, control section C1 receives the above mentioned job information transmitted from communication unit T2 of image forming apparatus C via communication unit T1.

Here, as described above, in case of stacking the prescribed number of sheets, since any member to control the orientation of sheet P is not arranged between stacker entry roller 193 and the accumulation position in stacker 80, the leading edge of the sheet may hang down to caused the failure accumulation (failure accumulating). In order to prevent this, stiffness is imparted to sheet P to be ejected to stacker 80 for preventing the hanging down of the sheet leading edge.

Next, stiffness imparting to sheet P will be described.

For this stiffness imparting, corrugation section 200 (refer to FIG. 4), which being stiffness imparting means to impart stiffness to sheet P to be ejected onto stacker 80, is provided.

Figure 5:
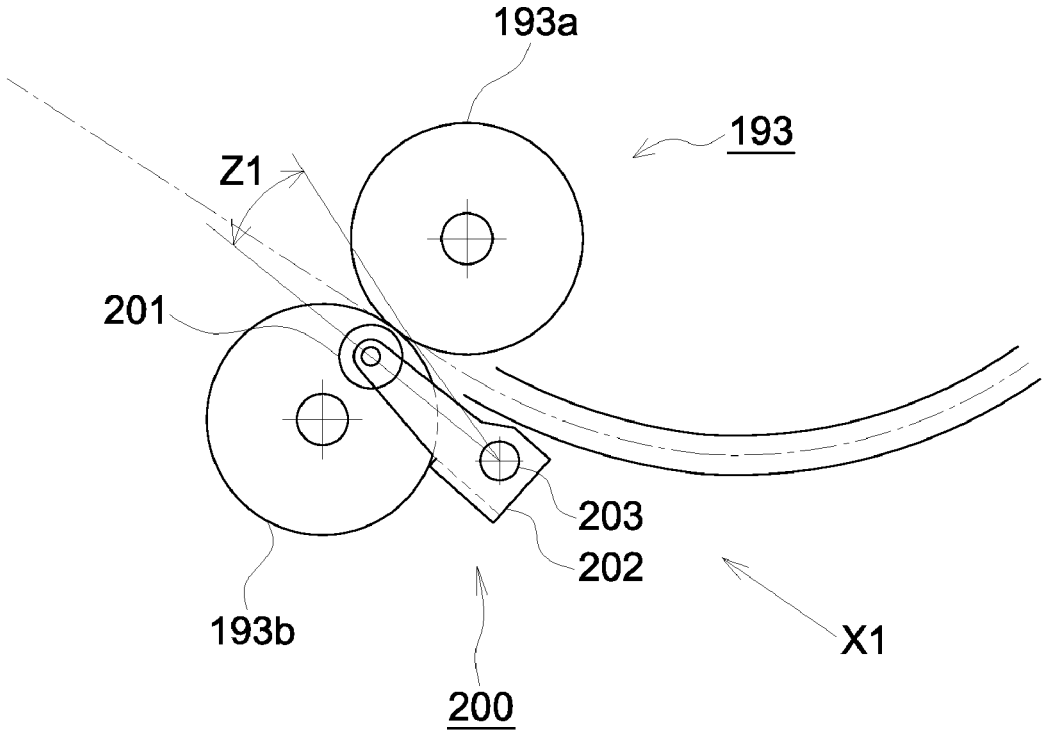
FIG. 5 is an enlarged view of corrugation unit 200.
Figure 6:
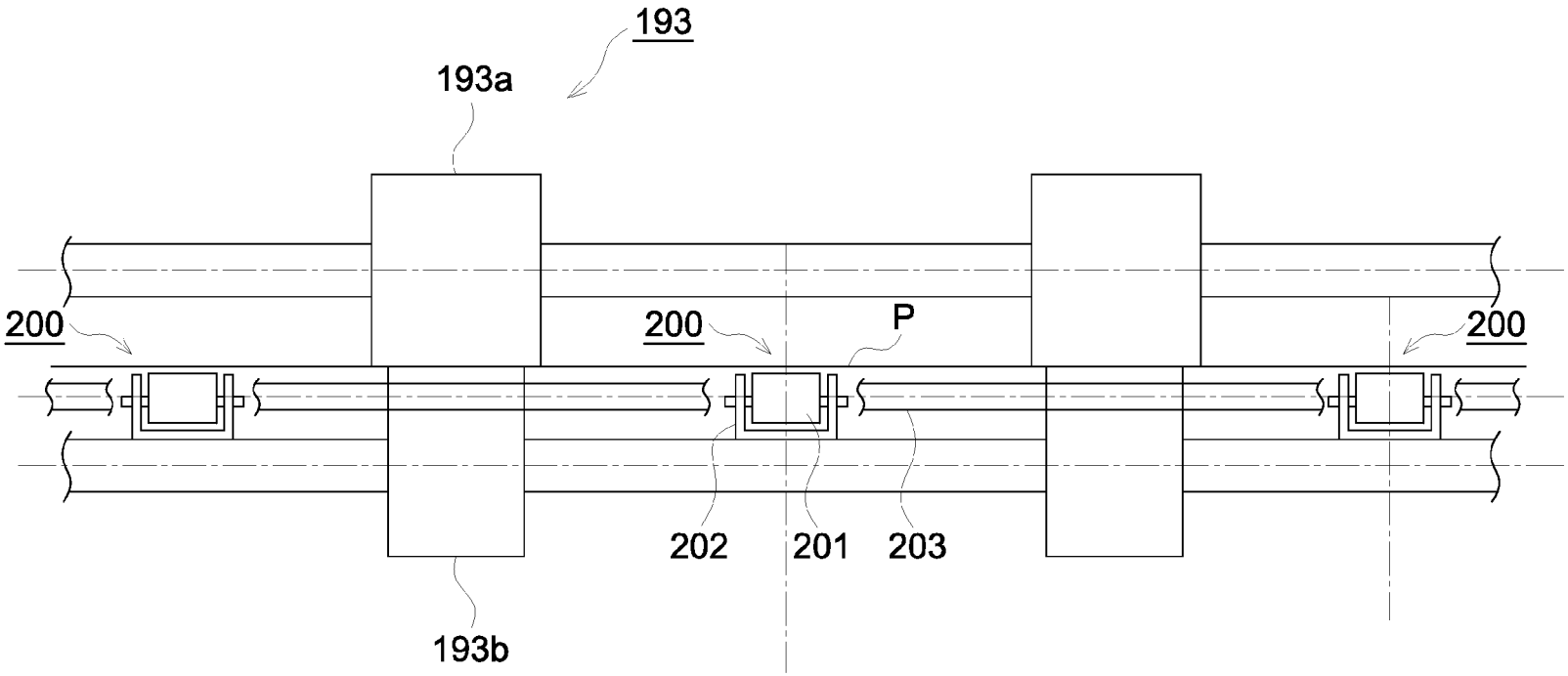
FIG. 6 is side view viewing from arrow mark X1 of FIG. 5.
Figure 7:
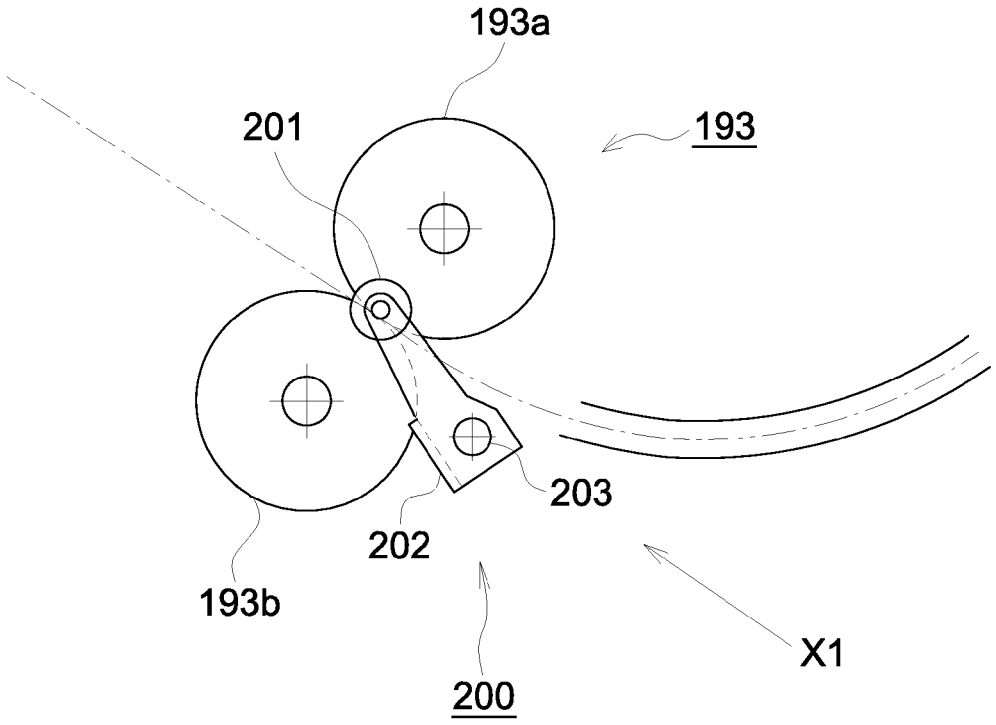
FIG. 7 is an enlarged view of corrugation unit 200.
Figure 8:
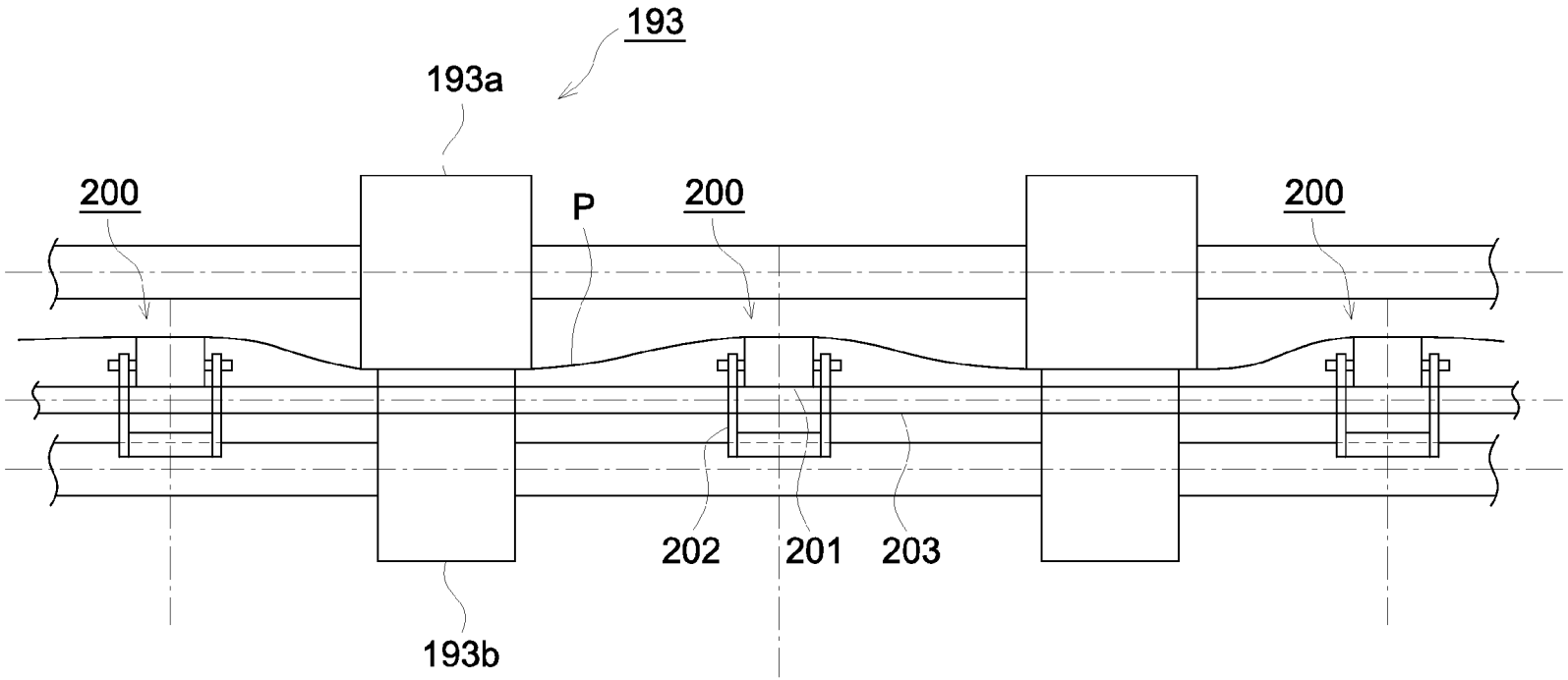
FIG. 8 is side view viewing from arrow mark X1 of FIG. 7.

FIGS. 5 and 7 are enlarged drawings of corrugation section 200. FIG. 6 is a side view of FIG. 5 viewing from a direction of arrow mark X1, and FIG. 8 is a side view of FIG. 7 viewing from a direction of arrow mark X1.

Corrugation section 200 is provided with corrugation roller 201, roller supporting plate 202 to rotatably support corrugation roller 201, and corrugation axis 203 to support roller supporting plate 202. Roller supporting plate 202 is fixed to corrugation axis 203.

Corrugation axis 203, being rotated by a drive means (not illustrated), swings roller supporting plate 203 to the direction of arrow mark Z1, namely, swings corrugation roller 201 in the direction of arrow mark Z1.

FIG. 5 shows the state where corrugation roller 201 stays at a waiting position, and FIG. 7 shows the state where corrugation roller 201 resides at a position having been swung (swung position).

Hereinafter, the waiting position state of corrugation roller 201 as shown in FIG. 5 is referred as corrugation OFF state, and the swung position state as shown in FIG. 7 is referred as corrugation ON state.

Control section C1 controls the corrugation ON/OFF.

In the corrugation OFF state shown in FIG. 5, corrugation roller 201 is evacuated from the conveyance path, and does not contact the sheet P entering into stacker entry roller 193. Namely, as shown in FIG. 6, the sheet P entering into stacker entry roller 193 is in flat plane state in the width direction.

In the corrugation ON state shown in FIG. 7, corrugation roller 201 traverses the conveyance path and moves to the side of driven roller 193*a*. Due to this, the sheet P entering into stacker entry roller 193 is guided by a side surface of roller supporting plate 202, and runs over corrugation roller 201. This state is shown in FIG. 8.

As shown in FIG. 8, sheet P is made wave formed of concavity and convexity in the width direction, namely, sheet P is imparted wave-formed corrugation. Accordingly, sheet P is imparted stiffness in conveying direction.

Although the case is employed where the corrugation roller swings from the side of drive roller 193 toward the side of driven roller 193*a* in the present embodiment, another case of swinging in reverse direction is also employable. Further, a combination of swings in both directions is also possible.

Control section C1 controls to corrugation ON in cases when stacker entry roller 193 conveys sheet P toward stacker 80. By this, the hanging down at the leading edge of sheet P is prevented. Further, stacker entry roller 193 ejects sheet P in stacker 80.

In this way by imparting stiffness to sheet P to convey into stacker 80 while preventing the hanging down of the sheet leading edge, prevention of failure accumulation in stacker 80 is made possible.

As described above, in cases of accumulating a prescribed number of sheet P in stacker 80 and executing a prescribed process such as stapling process, since ejection of sheet P into stacker P is impossible during execution of the process, the successive sheet cannot be conveyed into stacker 80.

Accordingly, the image forming apparatus is made to temporarily stop, which reduces the production ratio of the image forming apparatus.

In order not to reduce the production ratio, it is preferable to make the continued operation of the image forming apparatus possible.

For this purpose, sheet P entered into stacker entry roller 193 is necessary to be conveyed to other conveyance destination and made to wait until accumulation on the stacker becomes possible.

In the present embodiment, conveyance path "d" is provided as the other conveyance destination, and is utilized as a waiting site of sheet P. In conveyance path "d", guide member GP is arranged to guide sheet P.

This conveyance path "d" has a curved surface in its part (as shown in FIG. 3 and FIG. 4). In this way, by making a part of conveyance path "d" to be curved shape, and changing the traveling direction of sheet P conveyed from stacker entry roller 193, namely by changing from an approximately horizontal direction to an approximately vertical direction, space-saving is achieved in the conveyance direction (right/left direction in FIG. 3) of conveyance path "d".

Further conveyance path "d" may be also used in double purpose as a sheet conveyance path to another processing section (not illustrated) such as a saddle stitch process section.

As shown in FIG. 3 and FIG. 4, in conveyance path "d", conveyance roller 194 structured with a pair of drive roller and driven roller is arranged. Further, in order to convey sheet P entered into stacker entry roller 193 toward conveyance path "d", gate G3 for switching the conveyance path is provided. Gate G3 is swung by a drive unit (not illustrated) between the positions indicated by solid and dotted lines in FIG. 4. By this, the conveyance path is switched.

Conveyance of sheet P entered into stacker entry roller 193 toward conveyance path "d" is executed by conveying sheet P with stacker entry roller 193 in a direction reverse to the one toward stacker 80.

Hereinafter, conveyance of sheet P with stacker entry roller 193 toward conveyance path "d" is referred also as a switch-back, in the present description.

The number of sheet P to be made wait at conveyance path "d" is not limited to one, but a plurality of sheets can be piled up, namely a plurality of sheets can be accumulated in conveyance path "d". Namely, conveyance path "d" has a function of holding a bundle of sheets accumulated with a plurality of sheet P.

In cases of conveying sheet P entered in stacker entry roller 193 toward stacker 80, control section C1 controls to make corrugation ON to impart stiffness to sheet P, for preventing the sheet edge hanging down and enhancing straight line traveling of the sheet. However in cases of conveying sheet P to conveyance path "d", if the stiffness is imparted to sheet P as in the case of ejecting into stacker 80, by an influence of irregularity of wave-shaped corrugation, a paper jam is possibly caused at conveyance roller 194. Further, the leading edge of sheet P may hit guide member GP at the curved portion of the conveyance path, causing damage to sheet P.

In the present invention, in order to prevent these jams and damages, control section C1 controls to make corrugation OFF not to impart stiffness to sheet P, in cases of conveying sheet P entered in stacker entry roller 193 toward conveyance path "d".

As described above, according to the conveying destination selected from a plurality of destinations such as stacker 80 and conveyance path "d", control section C1 selects corrugation ON or OFF to control imparting or not imparting the stiffness to sheet P.

This stiffness imparting control is executed to impart the stiffness in cases when any roller for nipping and conveying sheet P, curved guide surface, or member to control the orientation of sheet P is not arranged in the conveyance path as the conveyance destination of stacker 80. While, the stiffness is not imparted, in cases where a roller for nipping and conveying sheet P, a curved guide surface, or a member to control the orientation of sheet P is arranged in the conveyance path such as the conveyance destination of conveyance path "d".

By the above described configuration, in cases of accumulating the sheets on stacker 80 and executing post-processing, a post-processing apparatus can be realized without causing failure sheet accumulation on stacker 80 or sheet damages, without causing a jam during sheet conveyance, and without causing reduction of production ratio of the image forming apparatus.

Next, conveyance of sheet P from stacker entry roller 193 to a plurality of conveyance destinations will be described.

In cases where stapling process or folding process is set, sheet P is fed into conveyance path "c" by switching gate G2 (refer to FIG. 3). Sheet P having been fed-in is conveyed by conveyance roller 191, 192 to enter into stacker entry roller 193. At this time, switching gate G3 resides at the solid line position in FIG. 4.

Further, stacker entry roller 193 conveys sheet P toward stacker 80.

When sheet P enters into stacker entry roller 193, control section C1 sets corrugation section 200 in corrugation ON state (FIG. 8, FIG. 8). This leads to impart stiffness to sheet P and prevent sheet edge hanging down that may be generated at the time of conveyance toward stacker 80 by stacker entry roller 193.

In cases where sheet P is allowed to be ejected to stacker 80, stacker entry roller 193 ejects sheet P to stacker 80.

In cases where sheet P is not allowed to be ejected to stacker 80 because of stapling process, folding process or the like, stacker entry roller 193 stops in the state of nipping a trailing edge of sheet P. This stop timing can be controlled by detecting the trailing edge of sheet with sheet trailing edge detection sensor 51 shown in FIG. 4. Further this stop timing may be controlled by the time of sheet P conveyance with conveyance roller 191-192, and stacker entry roller 193.

Figure 9:
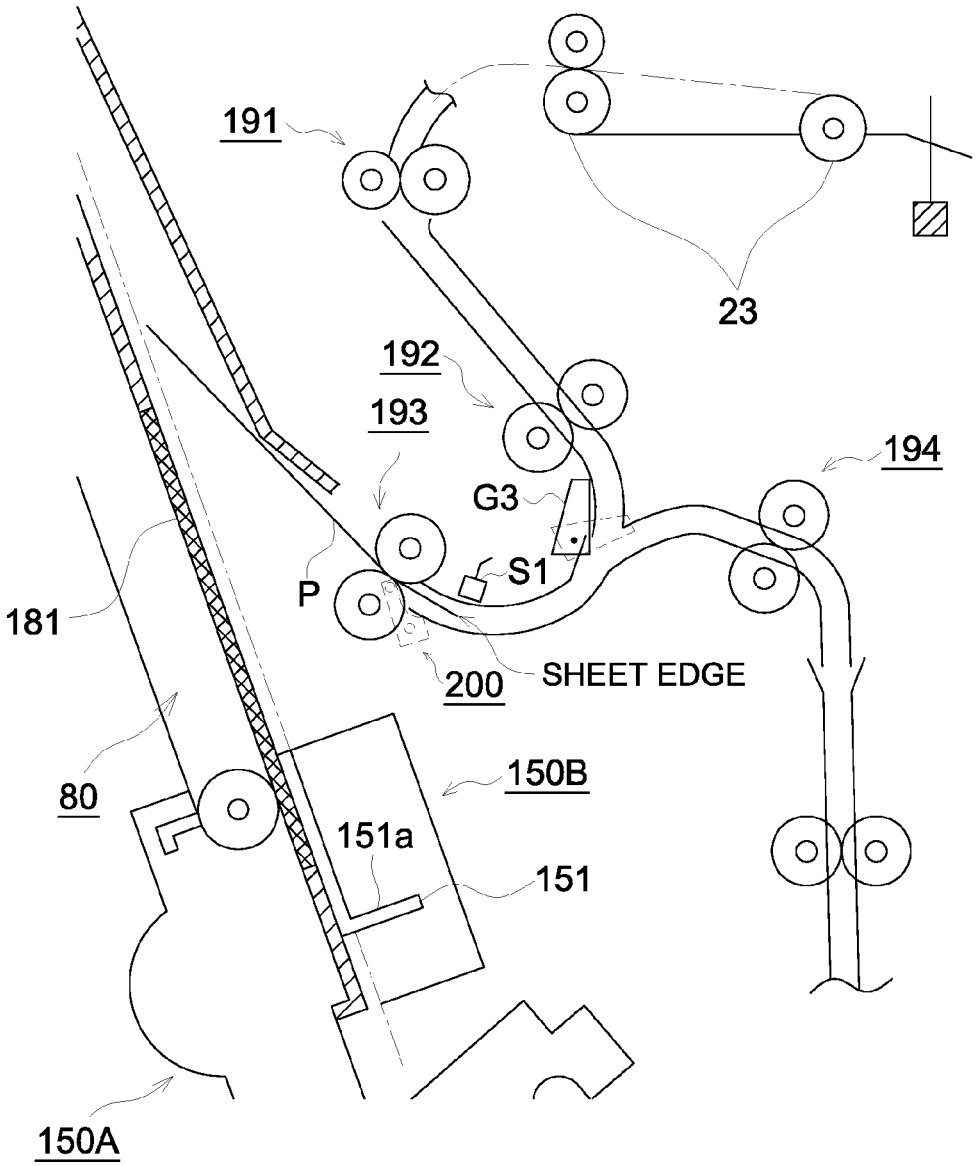
FIG. 9 is a drawing to show a state where stacker entry roller 193 stops by nipping a trailing end of the sheet.

FIG. 9 illustrates the state where stacker entry roller 193 stops by nipping the trailing edge of sheet P.

Next, gate G3 is swung and moves to the dotted line position. By this, conveyance path "d" is selected as the conveyance destination from stacker entry roller 193. Control section C1 sets corrugation OFF state (FIG. 5, FIG. 6), and reversely rotates stacker entry roller 193. At the same time, conveyance roller 194 is also driven to rotate in the same direction as stacker entry roller 193. By this, sheet P switchbacks by reversing the leading edge, to be conveyed toward conveyance path "d" and stops at a prescribed position in waiting state. Hereinafter, this sheet P is referred as a "first sheet".

When the conveyance leading edge of switch-backing sheet P enters into conveyance roller 194, gate G3 is swung and moves to the solid line position.

Figure 10:
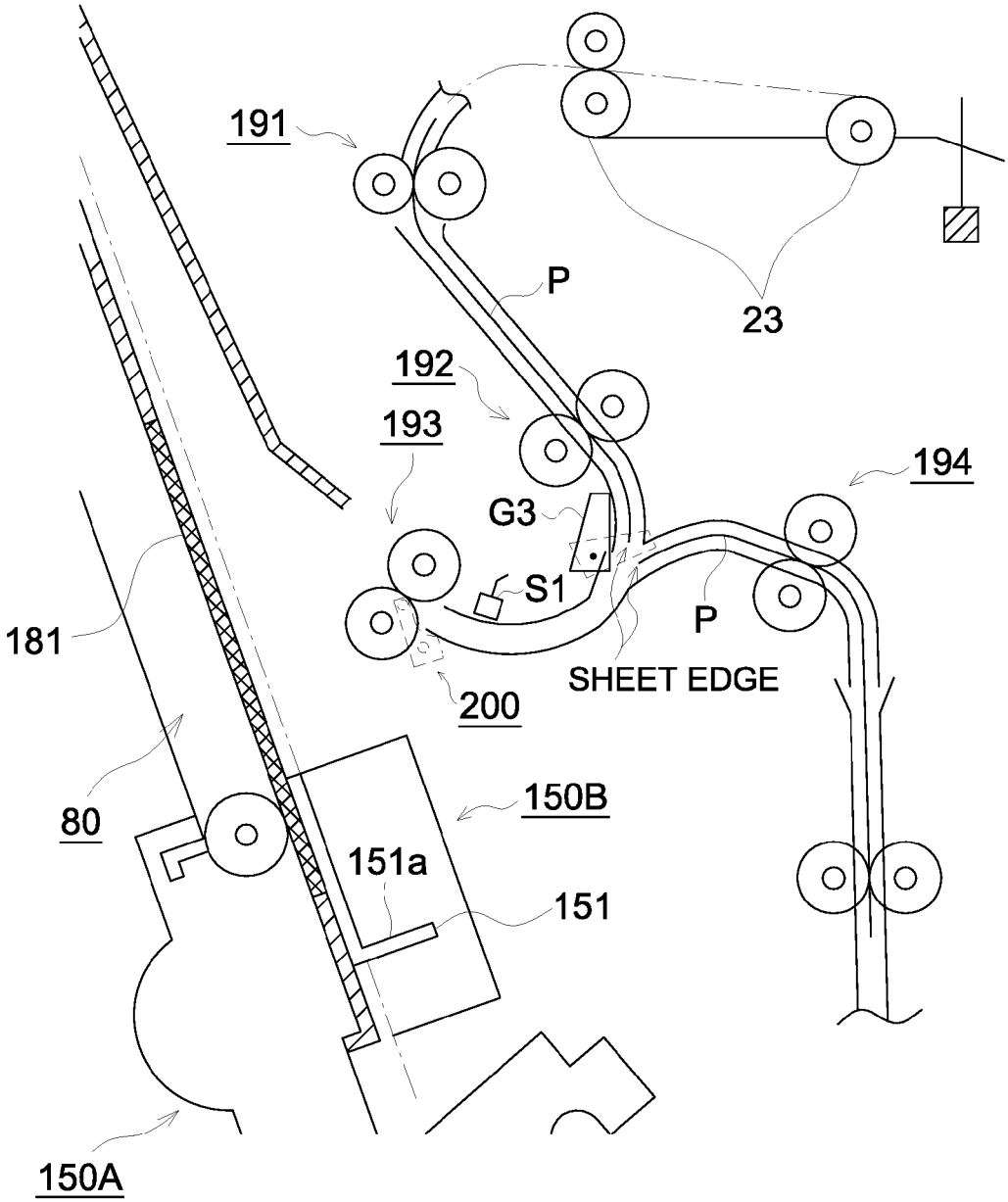
FIG. 10 is a drawing to show a state where the sheet having been conveyed into conveyance path "d" is waiting, and a subsequent sheet is conveyed.

FIG. 10 illustrates the state where the first sheet is conveyed through conveyance path "d" to be in wait state, and the next sheet is conveyed in.

Next, when the next (the second) sheet P is conveyed similarly to the first sheet by conveyance rollers 191-192, the first sheet is conveyed toward stacker entry roller 193 by conveyance roller 194, in agreement of timing such that the leading edge of the first sheet coincides with the leading edge of the second sheet.

In this way, the first and second sheets are overlapped and enter into stacker entry roller 193 in accumulated state.

Hereinafter, the bundle of sheet made of multiple accumulated sheets P is referred as accumulated sheets.

When the accumulated sheets enter into stacker entry roller 193, control section C1 sets corrugation section 200 in corrugation ON state, in the same way as the case of the first sheet.

This leads to impart stiffness to the accumulated sheets similarly to the case of the first sheet, and prevent sheet edge hanging down that may be generated at the time of conveyance toward stacker 80 by stacker entry roller 193.

In cases where sheet P is allowed to be ejected to stacker 80, stacker entry roller 193 ejects the accumulated sheets to stacker 80.

In cases where sheet P is not allowed to be ejected to stacker 80, similarly to the case of the first sheet, because of stapling process, folding process or the like, stacker entry roller 193 stops in the state of nipping a trailing edge of the accumulated sheets. Then, the state becomes similar to that shown in FIG. 9.

After that, similarly to the case of first sheet, the accumulated sheets are conveyed to conveyance path "d", and made in waiting state.

Next, when the next (the third) sheet P is conveyed similarly to the first sheet by conveyance rollers 191-192, the accumulated sheets are conveyed toward stacker entry roller 193 by conveyance roller 194, in agreement of timing such that the leading edge of the accumulated sheets coincides with the leading edge of the third sheet.

In this way, the accumulated sheets and the third sheet are overlapped and enter into stacker entry roller 193 in accumulated state.

In this way, the above described operations of conveyance of sheet P, setting the corrugation ON/OFF, waiting, and overlapping (accumulation) are executed.

In this regard, the number of accumulated sheets of sheet P is restricted to be within the predetermined maximum number of accumulation sheets. Further, the conveying number of sheets is controlled such that the number of accumulated sheets in stacker 80 becomes a predetermined number.

In the above description, the series of operations regarding waiting and accumulation of sheets in conveyance path "d" is executed in cases where sheet ejection to stacker 80 is not allowed, however, these operations may be executed in cases where the ejection is allowed. For example, every accumulated five sheets may be ejected into stacker 80, even in cases where the ejection is allowed. In a case of stapling process of every five sheets, by ejecting the five sheets in accumulation into stacker 80, accurate accumulation of sheets is ensured in stacker 80.

Further, in the above described imparting of stiffness, in cases when conditions of imparting stiffness to sheet P (corrugation conditions) are set, control section C1 controls to automatically switch between imparting stiffness and not imparting, namely corrugation ON/OFF, according to the selected post-processing and the specifications of sheet, based on the corrugation conditions.

The corrugation conditions mean, in cases where the stapling process or the folding process is selected, to change whether to impart stiffness in regard to the process, according to the sheet specifications (sheet type). For example, in a case of sheet P which is not likely to hang down in its leading edge at the time of ejection, due to having a paper weight higher than a prescribed value, the corrugation is not applied (corrugation OFF), while in a case of sheet P which is likely to hang down, having a paper weight less than the prescribed value, the corrugation is applied (corrugation ON). Namely, the corrugation is not applied to a sheet of high stiffness, and the corrugation is applied to a sheet of low stiffness, and the like.

Selections of post-processing and sheet specifications are conducted by an operator through an operation panel of the image forming apparatus. The selection of sheet specifications may be conducted by selecting sheet feeding cassette 41 (*a*-*c*). Base on these selections of post-processing and sheet specification, and corrugation conditions, control section C1 controls whether to impart stiffness or not.

According to the above described embodiment, a post-processing apparatus can be configured, in cases of executing post-processing by accumulating the sheets in the stacker, that does not cause a failure accumulation of sheets in the stacker or a damage of sheet, does not cause a sheet jam at the time of sheet conveyance, and further does not cause decrease of production ratio of the image forming apparatus.

What is claimed is:

1. A post-processing apparatus comprising:

a stacker for stacking sheets for executing a post-processing;

a conveyance path to accommodate a sheet before the sheet is conveyed to the stacker;

a conveyance unit which selectively conveys a sheet to the stacker and to the conveyance path;

a stiffness imparting unit which imparts stiffness to the sheet conveyed by the conveyance unit; and a control section which controls the stiffness imparting unit, wherein the control section is configured to determine whether or not to control the stiffness imparting unit to impart stiffness to the sheet according to whether the conveyance unit conveys the sheet to the stacker or to the conveyance path.

2. The post-processing apparatus described in claim 1, wherein the control section controls to impart stiffness in cases in which rollers to nip and convey the sheet are not arranged in the stacker.

3. The post-processing apparatus described in claim 1, wherein the conveyance path is provided with a curved guide surface in at least a part of the conveyance path, and is configured to hold a bundle of accumulated sheets.

4. The post-processing apparatus described in claim 1, wherein in cases in which a condition for imparting stiffness is set, the control section controls, based on the condition, to automatically switch between imparting stiffness and not imparting stiffness, according to a selected post-processing and specifications of the sheet.

5. An image forming system comprising:

an image forming apparatus to form an image on a sheet; and a post-processing apparatus which receives the sheet from the image forming apparatus, and applies a post-processing to the sheet, wherein the post-processing apparatus comprises:

a stacker for stacking sheets for executing a post-processing;

a conveyance path to accommodate a sheet before the sheet is conveyed to the stacker;

a conveyance unit which selectively conveys a sheet to the stacker and to the conveyance path;

a stiffness imparting unit which imparts stiffness to the sheet conveyed by the conveyance unit; and a control section which controls the stiffness imparting unit, wherein the control section is configured to determine whether or not to control the stiffness imparting unit to impart stiffness to the sheet according to whether the conveyance unit conveys the sheet to the stacker or to the conveyance path.

6. A post-processing apparatus that executes at least one post-processing on a sheet conveyed from an image forming apparatus, the post-processing apparatus comprising:

a plurality of conveying destinations;

a conveyance unit which selectively conveys a sheet to the plurality of conveying destinations;

a stiffness imparting unit which imparts stiffness to the sheet conveyed by the conveyance unit; and a control section which controls the stiffness imparting unit, wherein the control section is configured to: (i) select a conveying destination from the plurality of conveying destinations according to information relating to the post-processing, and (ii) determine whether to control the stiffness imparting unit to impart stiffness to the sheet based on the selected conveying destination.

7. The post-processing apparatus described in claim 6, wherein the control section controls the stiffness imparting unit to impart stiffness in cases in which rollers to nip and convey the sheet are not arranged in a conveyance path that is the selected conveying destination, and controls the stiffness imparting unit not to impart stiffness in cases in which rollers to nip and convey the sheet are arranged in the conveyance path that is the selected conveying destination.

8. The post-processing apparatus described in claim 6, wherein one of the plurality of conveying destinations includes a conveyance path which is provided with a curved guide surface in at least a part of the conveyance path, and which is configured to hold a bundle of accumulated sheets.

9. The post-processing apparatus described in claim 6, wherein in cases in which a condition for imparting stiffness is set, the control section controls, based on the condition, to automatically switch between imparting stiffness and not imparting stiffness, according to a selected post-processing and specifications of the sheet.

10. The post-processing apparatus described in claim 6, wherein in a case in which the selected conveying destination is provided with a member for use in conveying the sheet, the control unit determines to control the stiffness imparting unit not to impart stiffness to the sheet, and wherein in a case in which the selected conveying destination is not provided with the member for use in conveying the sheet and in which a condition for imparting stiffness is set, the control section determines whether to control the stiffness imparting unit to impart stiffness to the sheet according to sheet specifications, and based on the condition for imparting stiffness.

11. An image forming system comprising:

an image forming apparatus which forms an image on a sheet; and a post-processing apparatus which receives the sheet from the image forming apparatus, and which executes at least one post-processing on the sheet, wherein the post-processing apparatus comprises:

a plurality of conveying destinations;

a conveyance unit which selectively conveys a sheet to the conveying destinations;

a stiffness imparting unit which imparts stiffness to the sheet conveyed by the conveyance unit; and a control section which controls the stiffness imparting unit, wherein the control section is configured to: (i) select a conveying destination from the plurality of conveying destinations based on received information relating to the post-processing to be executed on the sheet, (ii) control the stiffness imparting unit to impart stiffness to the sheet in a case in which the selected conveying destination is not provided with a member for use in conveying the sheet, and (iii) control the stiffness imparting unit not to impart stiffness to the sheet in a case in which the selected conveying destination is provided with a member for use in conveying the sheet.

12. The image forming system described in claim 11, wherein the plurality of conveying destinations include a first accumulation portion to accumulate a plurality of the sheets for a post-processing, and a second accumulation portion to accumulate sheets which are to be conveyed to the first accumulation portion.

13. The image forming system described in claim 12, wherein the first accumulation portion includes a stacker.

14. The image forming system described in claim 12, wherein the second accumulation portion includes a conveyance path and rollers to convey the sheet.

15. The image forming system described in claim 12, wherein the second accumulation portion includes a conveyance path and a curved guide surface in at least a part of the conveyance path.

* * * * *